US010273704B2

(12) United States Patent
Wastel

(10) Patent No.: US 10,273,704 B2
(45) Date of Patent: Apr. 30, 2019

(54) AUTOMATED PARKING GARAGE/SELF-STORAGE APPARATUS

(71) Applicant: Park Plus, Inc., Oakland, NJ (US)

(72) Inventor: Andreas N. Wastel, Randolph, NJ (US)

(73) Assignee: PARK PLUS, INC., Oakland, NJ (US)

( * ) Notice: Subject to any disclaimer, the term of this patent is extended or adjusted under 35 U.S.C. 154(b) by 813 days.

(21) Appl. No.: 13/659,132

(22) Filed: Oct. 24, 2012

(65) Prior Publication Data

US 2013/0166105 A1 Jun. 27, 2013

Related U.S. Application Data

(60) Provisional application No. 61/579,411, filed on Dec. 22, 2011.

(51) Int. Cl.
*E04H 6/24* (2006.01)
*E04H 6/36* (2006.01)
*E04H 6/42* (2006.01)

(52) U.S. Cl.
CPC ..... *E04H 6/24* (2013.01); *E04H 6/36* (2013.01); *E04H 6/422* (2013.01)

(58) Field of Classification Search
CPC .. E04H 6/00; E04H 6/22; E04H 6/245; E04H 6/24; E04H 6/285; E04H 6/282; E04H 6/183
USPC ..... 701/23, 1, 2, 300, 301
See application file for complete search history.

(56) References Cited

U.S. PATENT DOCUMENTS 5,425,612 A * 6/1995 Ebstein ..... 414/254
2005/0207876 A1* 9/2005 Springwater ..... 414/231
2010/0181136 A1* 7/2010 Swasey et al. ..... 180/253
2010/0183409 A1* 7/2010 Checketts et al. ..... 414/231
2010/0185353 A1* 7/2010 Barwick et al. ..... 701/23
2011/0082588 A1† 4/2011 Mcdowell, Jr. et al.
2013/0008734 A1† 1/2013 Swasey
2013/0041546 A1† 2/2013 Barwick
2013/0311030 A1† 11/2013 Barwick

OTHER PUBLICATIONS

Boomerang Robotic Valet Automated Parking System available at https://www.youtube.com/watch?v=QAp-ttE8uko.,(see snap shots attached herein as PDF file pp. 1-48). Dec. 28, 2010.*
Boomerang RoboticValet® Automated ParkingSystem, available at http://www.youtube.com/watch?v=QAp‐ttE8uko.†

* cited by examiner
† cited by third party

*Primary Examiner* — Mussa A Shaawat
*Assistant Examiner* — Abdhesh K Jha
(74) *Attorney, Agent, or Firm* — Gerald E. Hespos; Michael J. Porco; Matthew T. Hespos

(57) ABSTRACT

A parking system includes a plurality of trays having a parking platform for supporting a vehicle and legs for keeping the parking platform in an elevated position on a supporting surface of the parking facility. The parking system also has at least one automated guided vehicle for moving the tray with the vehicle thereon between an access location and a specified parking location. The automated guided vehicle has a frame and drive devices mounted on the frame. Each drive device has a turntable rotatable about a vertical axis and two independently driven wheels mounted on the turntable. The automated guided vehicle can fit beneath the parking platform of the tray and can lift the tray for moving the tray and the vehicle between the access location and the specified parking location.

15 Claims, 11 Drawing Sheets

AUTOMATED PARKING GARAGE/SELF-STORAGE APPARATUS

CROSS-REFERENCE TO RELATED APPLICATIONS

This application claims priority on U.S. Provisional Patent Appl. No. 61/579,411 filed on Dec. 22, 2011, the entire disclosure of which is incorporated herein by reference.

BACKGROUND OF THE INVENTION

1. Field of the Invention

The invention relates to an automated parking garage, trays for supporting passenger vehicles in an automated parking garage, automated guided vehicles for moving the trays with or without the passenger vehicles thereon and a method for operating such a garage. The invention also relates to an automated self-storage facility, a combination of parking and self-storage facility, a storage container carried by an automated guided vehicle for self-storage and a method for operating such a facility.

2. Description of the Related Art

Urban areas throughout the world continue to grow in size and population density, and the number of vehicles in an urban area varies directly with the population size and density. As a result, parking availability is a major problem in most urban areas.

Vehicle lift devices have been used in parking lots for decades to increase the number of vehicles that can be parked in a given area. More particularly, a vehicle lift device has one or more platforms that can receive a vehicle. The lift device then elevates the vehicle on the platform so that at least one additional vehicle can be parked under the platform. Vehicle lift devices that can park four or more vehicles in a vertical array are fairly common. Lift devices of this general type are available from Park Plus, Inc. and are disclosed in the patent literature. Parking lots that rely upon vehicle lift devices require considerable room for the vehicle owner and/or the parking lot operator to maneuver vehicles from the entrance of the facility to the appropriate vehicle lift device. Most parking lots and parking garages that rely upon this technology do not have automated systems for locating the vehicle or for organizing the stacked arrangement of vehicles. As a result, a significant amount of maneuvering is required to park or retrieve a vehicle. These parking systems tend to be very labor intensive and create the potential for minor accidents as the vehicles are being maneuvered.

Parking garages can extend several stories high, and therefore permit a larger number of vehicles to be parked with in a given geographic footprint. However, a conventional parking garage requires considerable space for vehicle maneuvering. The above-described vehicle lift devices can be employed in a parking garage to increase the number of vehicles that can be accommodated. However, few parking garages will permit more than two vehicles to be stacked vertically on any floor of the parking garage.

Some parking systems include complex mechanisms to move a vehicle through an array of X, Y, Z coordinates from an ingress location to a parking location. These systems subsequently retrieve the parked vehicle and return the retrieved vehicle to an egress location. Most of these existing systems use technology that has been available in automated warehouses for decades. In particular, the typical automated parking system of this type requires the vehicle to be driven into a carrier that has a rectangular platform, four corner stanchions extending up from the respective corners of the platform and horizontal top supports that connect upper ends of the stanchions. The vehicle is driven onto the platform of the carrier and the carrier then is moved through a specified array of X, Y, Z coordinates to a particular parking location. The vehicle stays with the three-dimensional carrier for the duration of the parking. The carrier then is moved through a comparable array of X, Y, Z coordinates when the vehicle is to be retrieved so that the carrier with the vehicle thereon can be returned to an egress location where the vehicle is accessed by the driver. Carriers of this type occupy a large volume of space even when the carrier is not being used. These large carriers ideally should remain close to the entrance location of the automated parking facility so that empty carriers can be made available at the entry location to receive and process an incoming vehicle without a long wait time. As a result, the maneuvering of the carriers in a system of this type can be extremely complicated. Additionally, the mechanical systems that move the carriers through the X, Y, Z coordinates can be very complicated and inefficient.

Accordingly, an object of the invention is to provide an automated parking system that can process vehicles and their carriers in a manner that offers both time efficiencies and space efficiencies.

Another object of the invention is to provide an automated parking system that can achieve more efficient maneuvering of vehicles.

SUMMARY OF THE INVENTION

The invention relates to an automated parking system with a parking structure or location that has at least one level, and typically plural levels or floors. The parking structure has at least one bay for ingress and/or egress of vehicles. At least one vertically reciprocating conveyor (VRC) is provided for moving vehicles between the access point and a parking floor in the parking structure. The system also includes a plurality of stackable trays, each of which can accommodate a vehicle thereon. The system further includes at least one automated guided vehicle (AGV) that can transport at least one tray within the parking structure with or without a vehicle thereon.

The parking structure preferably has at least one ingress bay and at least one egress bay spaced from the ingress bay to ensure efficient processing of vehicles into and out of the parking structure. Additionally, each ingress and egress bay preferably may be provided with a dedicated VRC for moving to or from a specified floor. Each ingress and egress bay preferably is configured to permit a vehicle to be driven directly onto or off of a tray. For example, the trays may be nested in a recess at the ingress or egress location so that the top of the tray is flush with driving surfaces adjacent the ingress or egress.

Each ingress bay preferably has a sensor for sensing when a vehicle has been positioned properly on the respective tray. For example, each ingress location may have photo-optical sensors for sensing the positions of the front and/or rear ends of the vehicle to confirm that the vehicle has been positioned properly on the tray for subsequent movement of the vehicle with the tray. The sensors may be disposed and configured for confirming proper positioning of the vehicle both in a longitudinal direction and in a lateral direction on the tray. The sensors further may have means for signaling drivers when further movement is needed or when proper positioning on the tray has been achieved. The ingress bay further can include means for paying for the parking service and/or means for issuing a ticket or receipt that can be used when the vehicle is to be retrieved. Alternatively, a regular parker can have a machine-readable tag associated with the vehicle and the ingress location can have a reading apparatus to identify the vehicle by the tag associated with the vehicle. Communication between the reader and the tag on the vehicle can be used for payment purposes and or locating the vehicle when the vehicle is to be retrieved by the vehicle owner. Sensors at the egress bay can be similar to those at the ingress bay, but generally can be simplified. More particularly, sensors at the egress bay typically will be required merely to sense the presence of a loaded tray at the egress location and to sense the presence of an unloaded tray. The sensors at the egress location will be operative to ensure that only one loaded tray will be at each particular egress bay at any one time and to ensure that an unloaded tray is moved from the egress bay to an ingress bay or a magazine near an ingress bay.

The VRC may be registered vertically (z-axis) with the ingress bay and/or with the egress bay. Preferably, however, the VRC or VRCs are offset from the ingress or egress bays in the horizontal x-axis or y-axis directions. This latter option, for example, will permit a tray with a vehicle thereon to be translated horizontally from the ingress bay to a location where the tray/vehicle combination will be queued for processing onto a VRC. This option will ensure that vehicles can be processed through the ingress bay quickly without delays as the tray/vehicle combinations are waiting for availability of a VRC.

The various floors of the parking structure may be provided with means for guiding the automated guided vehicles around the particular floor between the VRC and the respective parking locations. For example, barcodes, RFID tags, lasers and/or guide wires may be attached to or embedded in the floor, ceiling, walls, pillars or the like.

Each tray of the parking system preferably is a generally rectangular structure dimensioned and structurally sufficient to accommodate a vehicle thereon. Additionally, each tray has a plurality of legs extending down and flared slightly in or out from the parking surface. The inward or outward flaring of the legs enables a plurality of the trays to be stacked in a nested array for storage when not in use. Thus, storage space near the VRCs and near the ingress and egress bays can be used in an optimal manner. The legs preferably are short and are intended merely to enable an automated guided vehicle (AGV) to advance into a position beneath the parking surface so that the tray can be lifted slightly and transported throughout the parking structure.

The automated guided vehicle (AGV) includes a substantially rectangular frame that defines a generally rectangular interior for storing the operative components of the AGV. The horizontal length and width dimensions of the frame are selected in accordance with the dimensions of the tray, which in turn is selected in accordance with dimensions of vehicles. More particularly, the length and width dimensions of the AGV are selected to enable the AGV to advance between the legs of the tray. The height dimension of the frame and the height dimension of the legs are selected to enable the AGV to advance between the floor on which the tray is supported and the lower side of the vehicle supporting surface of the tray.

Areas of the AGV inward of the frame include an array of batteries for providing the motive power to the AGV. Charging connections preferably extend from the batteries to an external location on the frame of the AGV. Thus, the AGV can be parked in proximity to a charging station and/or can be connected to a charging station for periodic recharging of the batteries. The charging can be carried out through a wired connection or through induction. Areas of the AGV inward of the frame further include controls that communicate with a central controller of the automated parking facility for receiving location and route information from the central controller of the automated parking facility and for guiding the AGV to the designated location.

Each AGV includes two raisable platform lifts that can be moved vertically relative to the horizontal plane defined by the frame of the AGV. The platform lifts preferably are disposed at opposite ends of the AGV or at all four corners of the AGV. The platform lifts are connected operatively to the control of the AGV and move between a retracted position and an extended position when the AGV is determined to have been positioned properly under a corresponding tray for lifting the tray. This relative positioning of the AGV and the corresponding tray can be determined by sensors provided on the AGV and/or on the tray.

Each AGV further includes a plurality of drive devices communicating with the control of the AGV and operative to drive the AGV to locations dictated by the control of the AGV and/or the control of the parking system. The preferred AGV includes four drive devices located respectively near the corners of the AGV. For example, the above-described platform lifts may be at the extreme opposite ends of the AGV and the drive devices may be inwardly of the platform lifts. Each drive device preferably includes two wheels mounted on a common axle or on two collinear axles. The rotational axes of the wheels all lie in a common plane that is parallel to the plane defined by the frame of the AGV and parallel to the horizontal surface on which the AGV is supported. Each wheel of each drive device preferably is driven by its own motor. The wheels and the corresponding motors of each drive device are mounted to a turntable that is rotatable about a vertical axis. The turntable of each drive device can be operated by the motors that drive the wheels. Rotation of the turntable causes rotation of the wheel/motor assembly about a vertical axis for steering the AGV. The wheels permanently extend below the lower surface of the frame of the AGV so that the wheels always carry the weight of the AGV.

The controller is operative to issue control instructions to the drive devices for operating the respective drive devices independently of one another, and in certain instances for operating the respective wheels of each drive device independently. As a result, steering of the respective drive devices is carried out pursuant to instructions from the controller by rotating one or more of the turntables and driving selected wheels in accordance with the required direction of travel.

The parking system of the invention operates by using the AGV to transport empty trays from the egress bay either to the ingress bay or to a storage magazine near the ingress bay. The empty tray may be deposited in a recess in the ingress bay or the egress bay so that the top parking surface of the tray is substantially flush with the approach surface for a vehicle entering the ingress bay or the exit surface for the vehicle leaving the egress bay. An approaching vehicle is guided by electro-optical signage and/or by audio instructions so that the vehicle can be positioned properly on the tray. The positioning of the vehicle on the tray is assessed by photo-optical sensors in the ingress bay and signage that will guide the driver of the vehicle to a proper stop position at which the vehicle is supported properly on the tray. The driver will exit the vehicle and may receive a receipt that can be used to reclaim the vehicle. The receipt can be a paper or cardboard receipt or an electronic receipt that can be loaded electronically onto a cell phone or other electronic device. Alternatively, the driver can use a credit card and a regular parker may merely use an assigned PIN. The sensors in the ingress bay may be operative for determining when the driver and any passengers have departed the vehicle and the ingress bay. The sensors also may determine the condition of the vehicle so that pre-existing damage can be documented. The tray with the vehicle thereon then is prepared for transport to the VRC. This preparation can include elevating the tray/vehicle combination sufficiently for engagement by an AGV that will transport the tray/vehicle combination to an VRC. Alternatively, the tray/vehicle combination can be advanced to the elevator by a horizontal conveyor system. Preferably, however, the AGV driving surface in the parking structure may be at the same level as the surfaces in the ingress and egress bays that support the trays. Thus, the AGV merely drives under the trays, lifts the tray and the vehicle thereon with the platform lifts and then transports the tray/vehicle combination from the egress bay toward the VRC. The parking structure can include a queue area between the ingress bay and the VRC for storing the tray/vehicle combinations while waiting for an elevator to become available.

The tray/vehicle combinations are loaded onto a VRC either by the conveyor system or by an AGV, which the leave the VRC with the tray and the vehicle therein. The VRC then transports the tray/vehicle combination to a selected floor for storing the vehicle. The floor and the storage location are selected and stored by the central controller of the parking facility. The location may be selected based on an intended parking duration or pickup time designated by the driver at the ingress bay. Once at the proper floor, an AGV will move between the legs of the tray and into a position for supporting the tray and the vehicle thereon. The platform lifts of the AGV then will activate to lift the tray sufficiently for the weight of the tray and vehicle to be supported by the AGV with the legs of the tray at a slight distance from the floor. The control unit of the AGV then will control the drive devices to move the AGV with the tray/vehicle combination thereon to the selected location on the floor of the parking structure. In this regard, the motors of the respective drive devices can be operated in accordance with independent instructions received from the control device on the AGV so that the wheels can be powered independently for guiding the AGV along an appropriate route to the selected parking location. Once at the selected parking location, the platform lifts of the AGV will lower the tray sufficiently for the legs of the tray to be supported on the floor. The AGV then will depart from the tray/vehicle combination and will proceed back to the VRC to await the next arriving tray/vehicle combination. Alternatively, the AGV may travel to retrieve a vehicle that must be delivered to the egress bay.

The above described process for parking a vehicle is substantially reversed for retrieving the vehicle. More particularly, an AGV will be dispatched to the vehicle location and move between the legs and under the tray. The platform lifts of the AGV will activate to raise the tray sufficiently for the legs to be spaced slightly from the floor. The AGV then will transport the tray/vehicle combination back to the VRC so that the vehicle can be transported to the egress bay for pickup by the driver.

DETAILED DESCRIPTION OF THE PREFERRED EMBODIMENT

Figure 1:
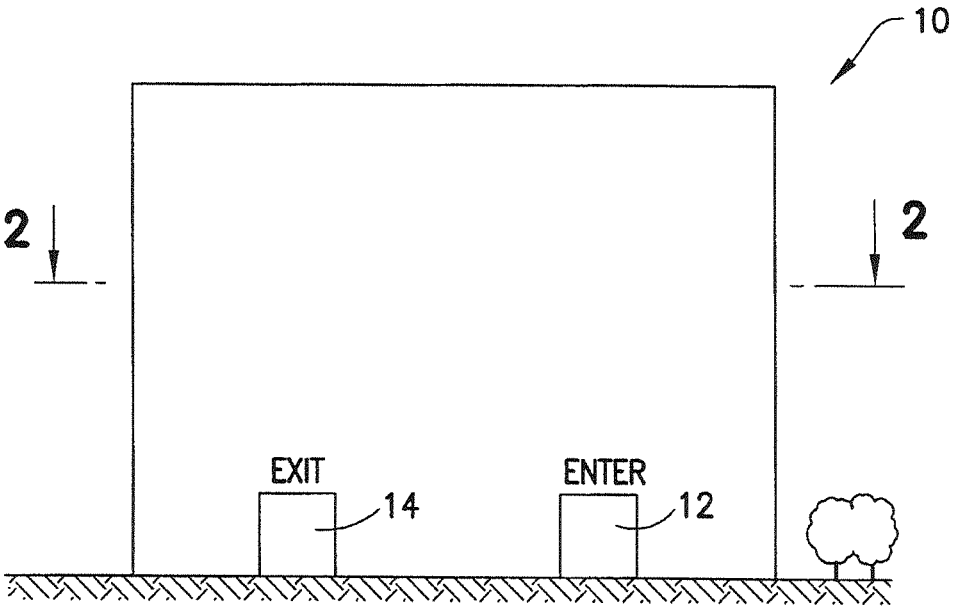
FIG. 1 is a front elevation view of a parking structure that includes the system of the subject invention.
Figure 2:
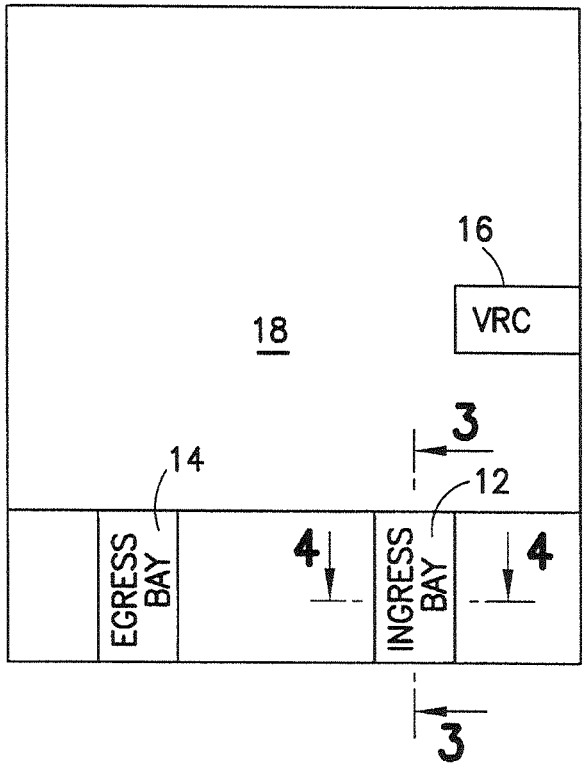
FIG. 2 is a cross-sectional view taken along line 2-2 of FIG. 1.

A parking garage in accordance with the invention is identified generally by the numeral 10 in FIGS. 1 and 2. The parking garage 10 includes an ingress bay 12 and an egress bay 14, each of which is dimensioned to receive an automotive vehicle. At least one vertical reciprocating conveyor (VRC) 16 is disposed in proximity to the ingress and egress bays 12 and 14. Additionally, a queue area 18 is disposed between the ingress bay 12 and the VRC 16 to accommodate an array of vehicles that are waiting for the VRC 16 to become available. Automated doors preferably are provided between the queue area 18 and in the ingress and egress bays 12 and 14 to prevent customers from accessing the queue area 18. The doors to the queue area 18 will be open only after the customer has left the ingress or egress bays 12 and 14. The parking garage 10 further includes a plurality of floors that can be accessed by the VRC 16. Each floor includes a plurality of areas where vehicles can be parked.

Figure 3:
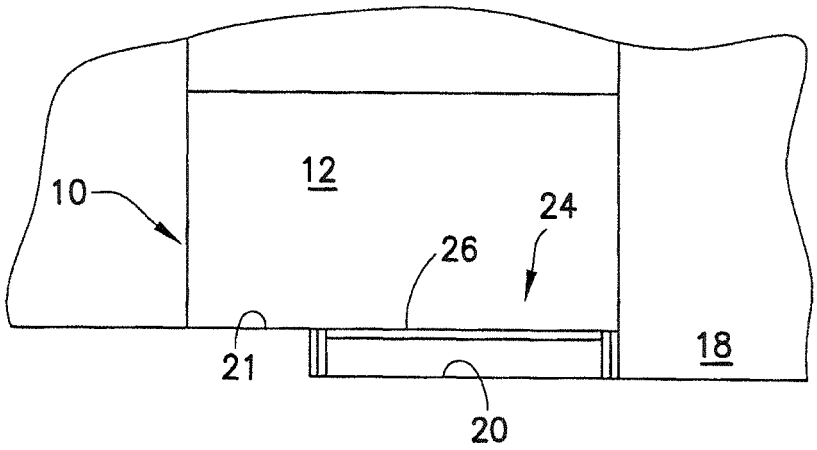
FIG. 3 is a cross-sectional view taken along line 3-3 of FIG. 2.
Figure 4:
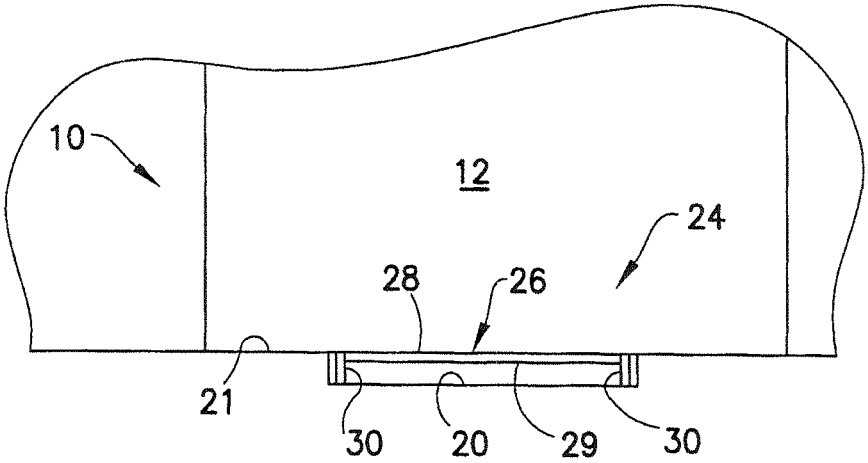
FIG. 4 is a cross-sectional view taken along line 4-4 of FIG. 2.
Figure 5:
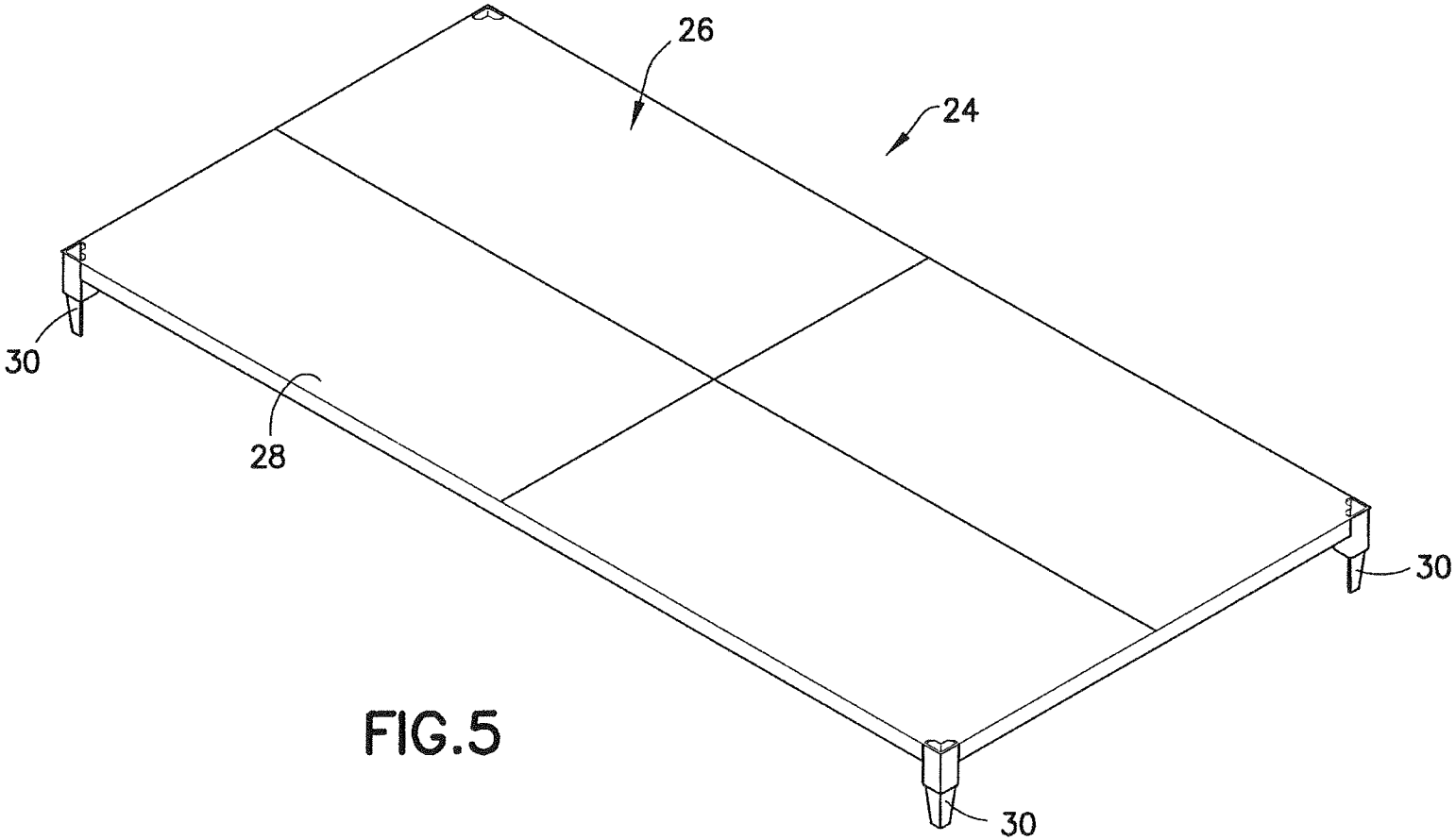
FIG. 5 is a perspective view of a tray in accordance with the invention.
Figure 6:
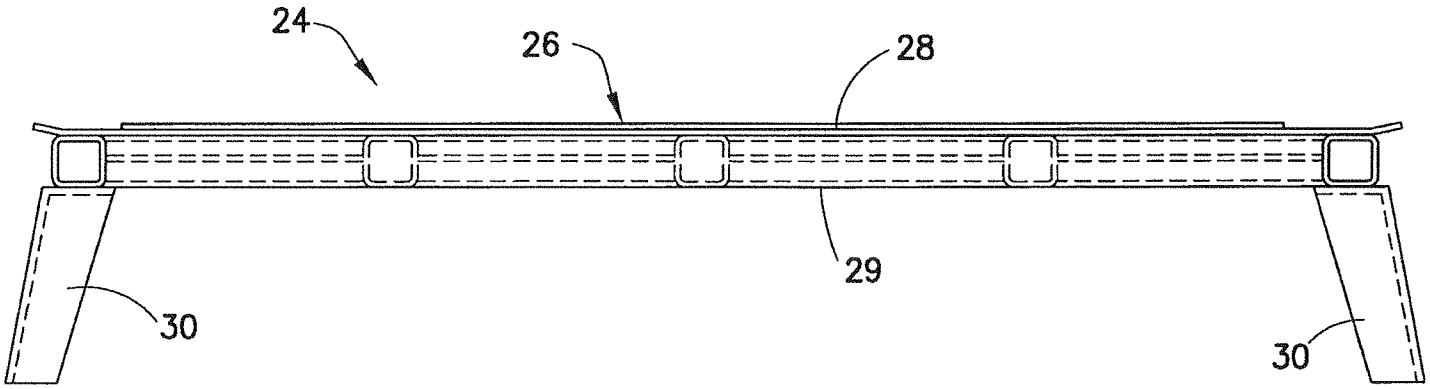
FIG. 6 is a side elevational view of the tray.
Figure 7:
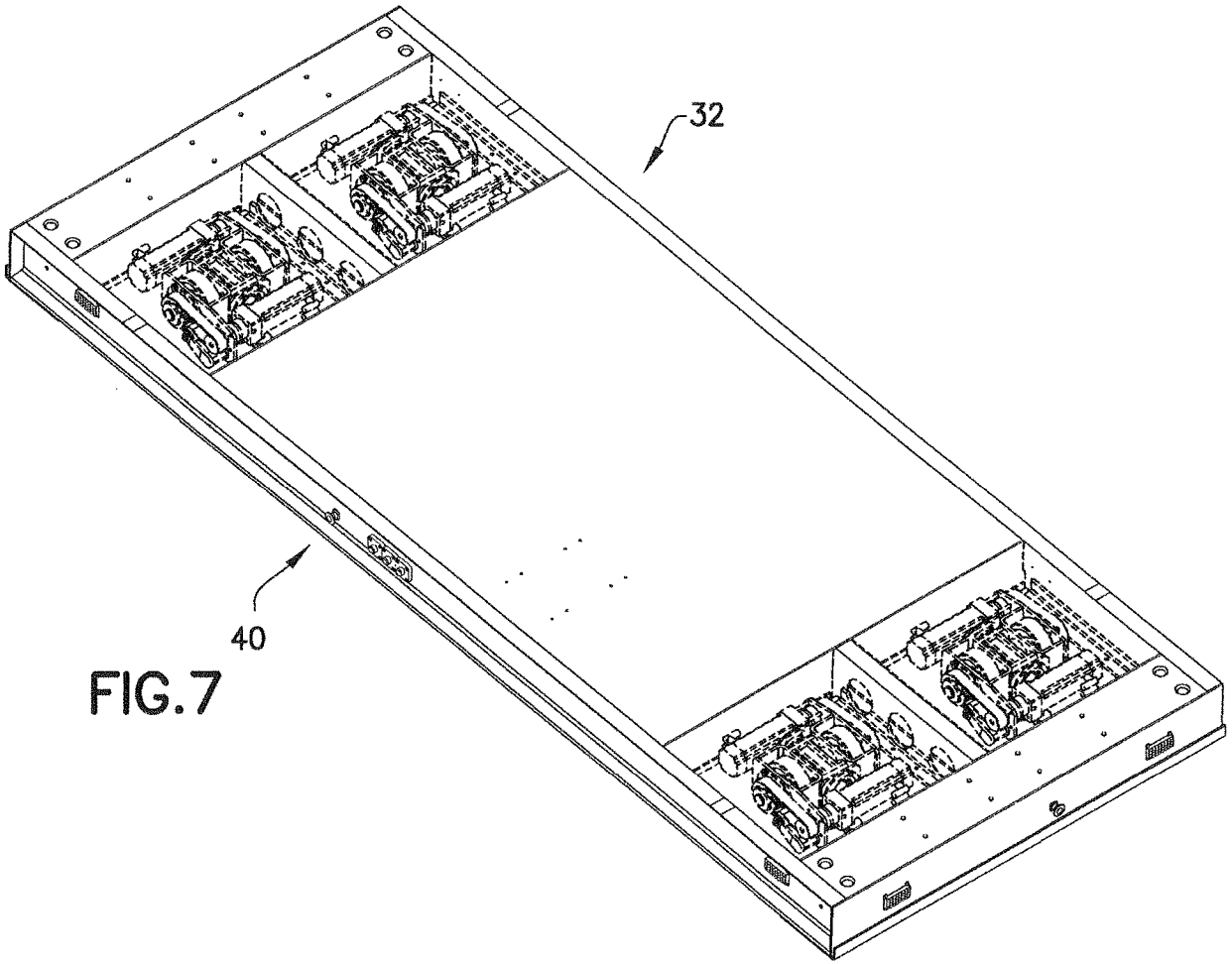
FIG. 7 is a bottom perspective view of an automated guided vehicle in accordance with the invention.
Figure 8:
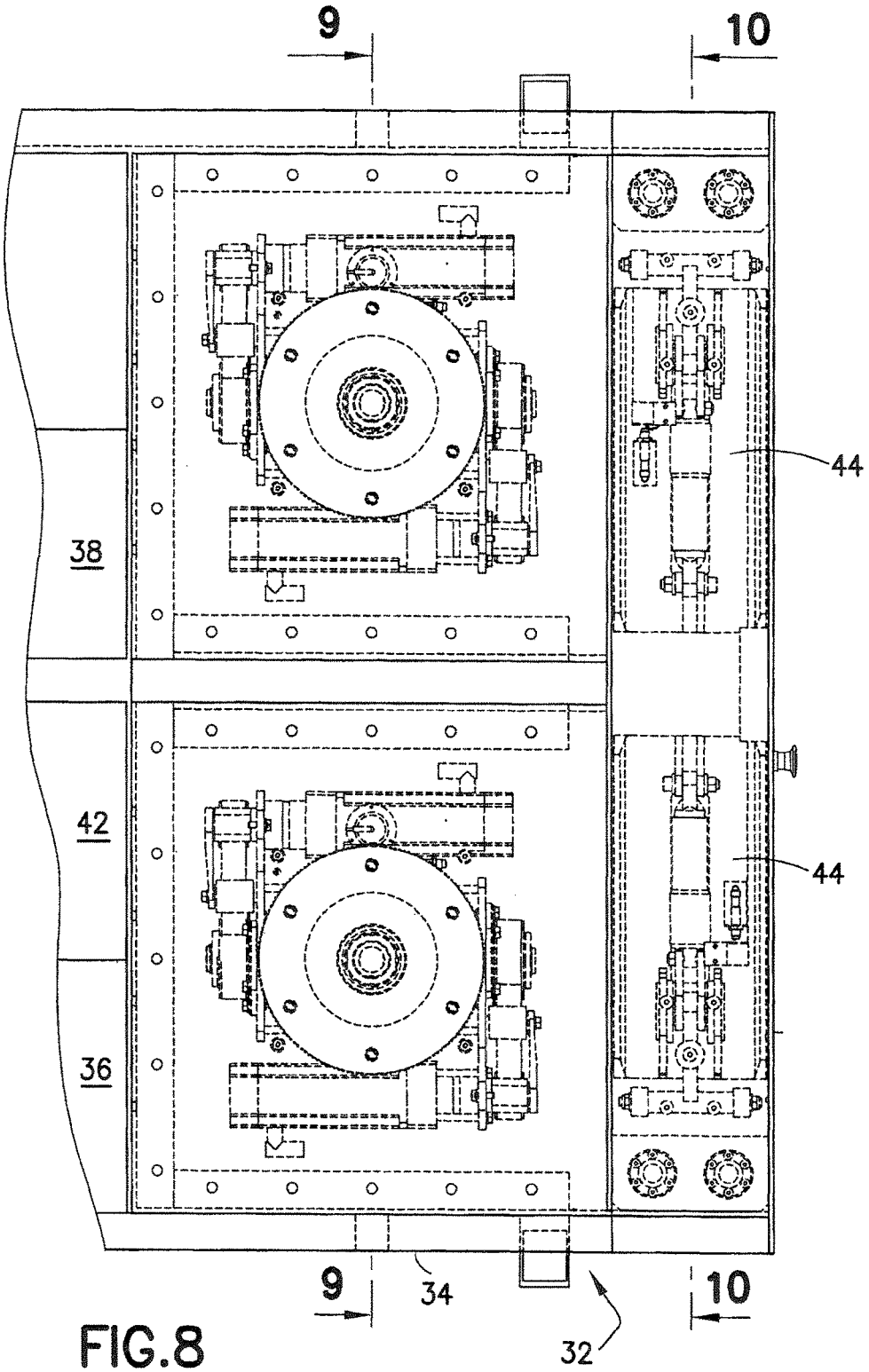
FIG. 8 is a bottom plan view of the automated guided vehicle.
Figure 9:
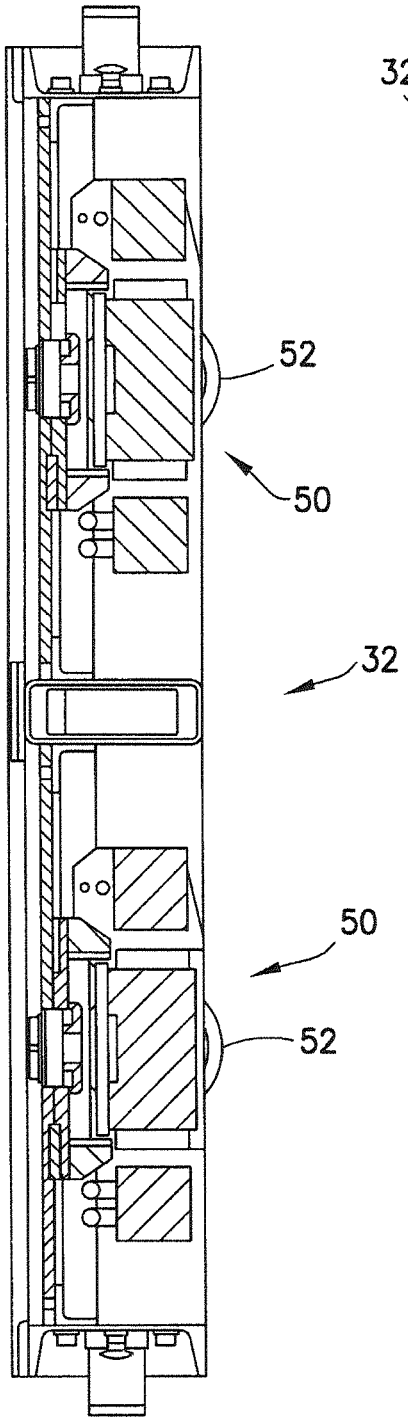
FIG. 9 is a cross-sectional view taken along line 9-9 in FIG. 8.
Figure 10:
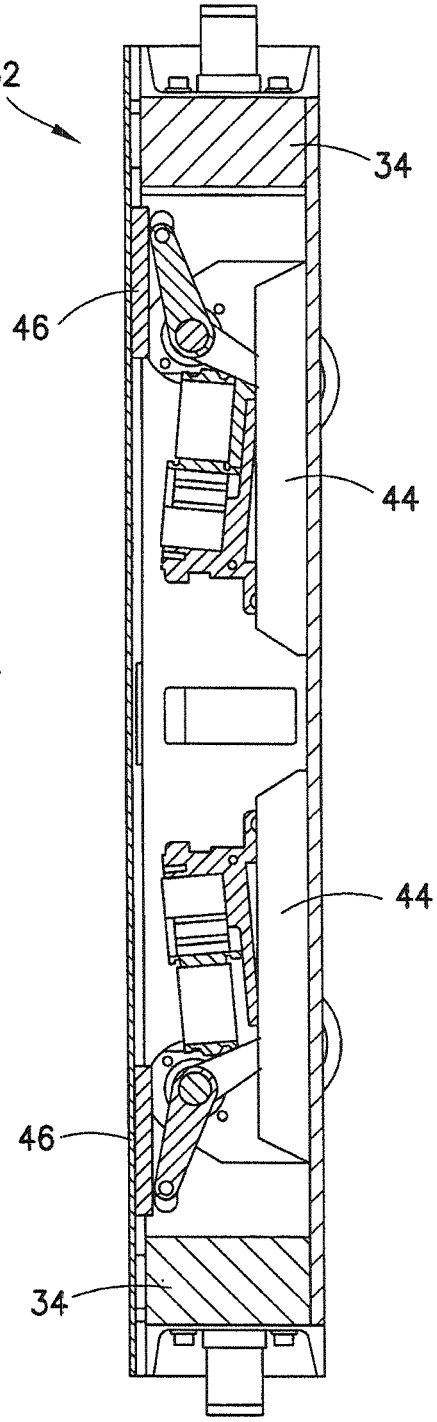
FIG. 10 is a cross-sectional view taken along line 10-10 in FIG. 8.
Figure 11:
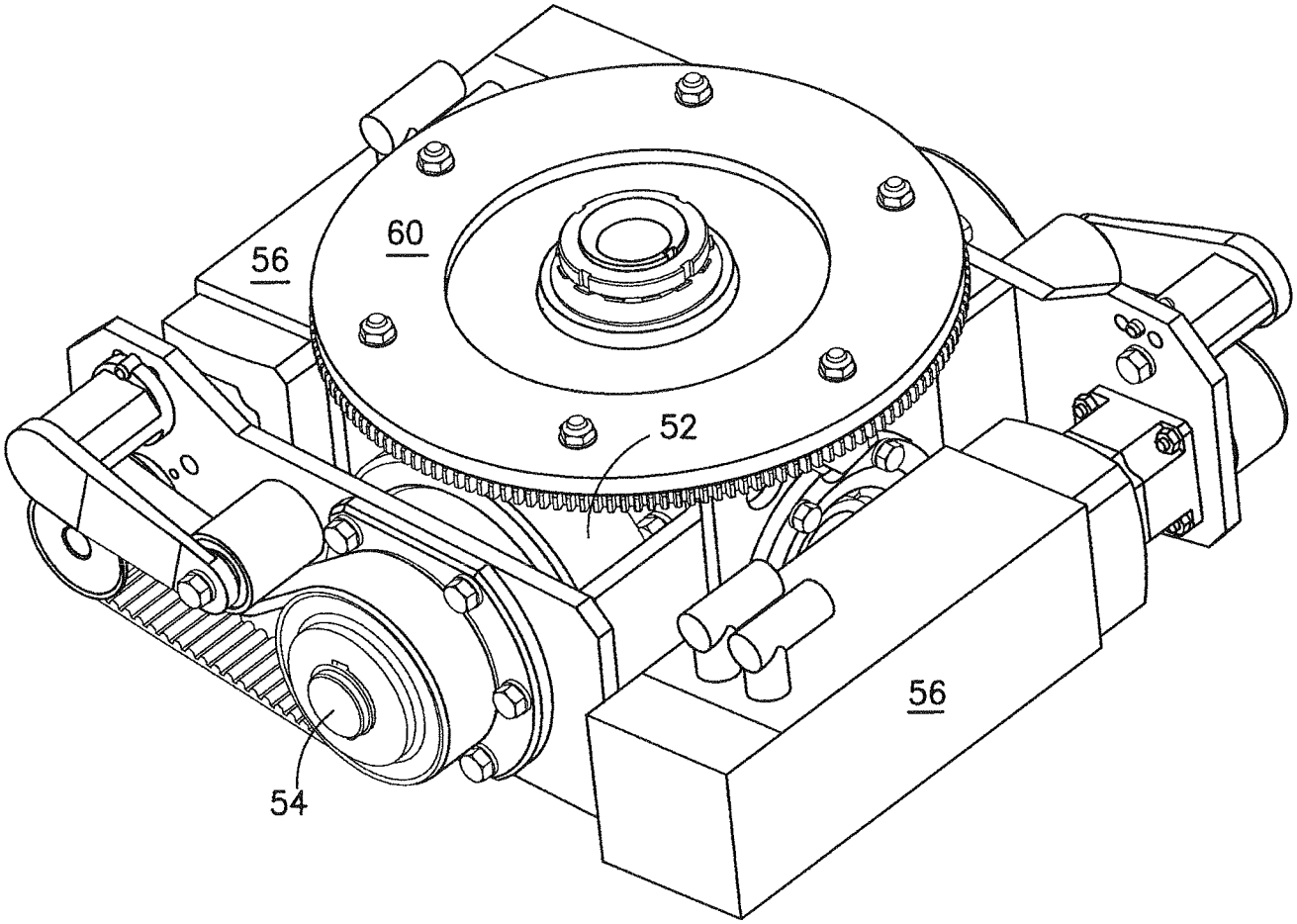
FIG. 11 is a perspective view of a drive device for the automated guided vehicle.
Figure 12:
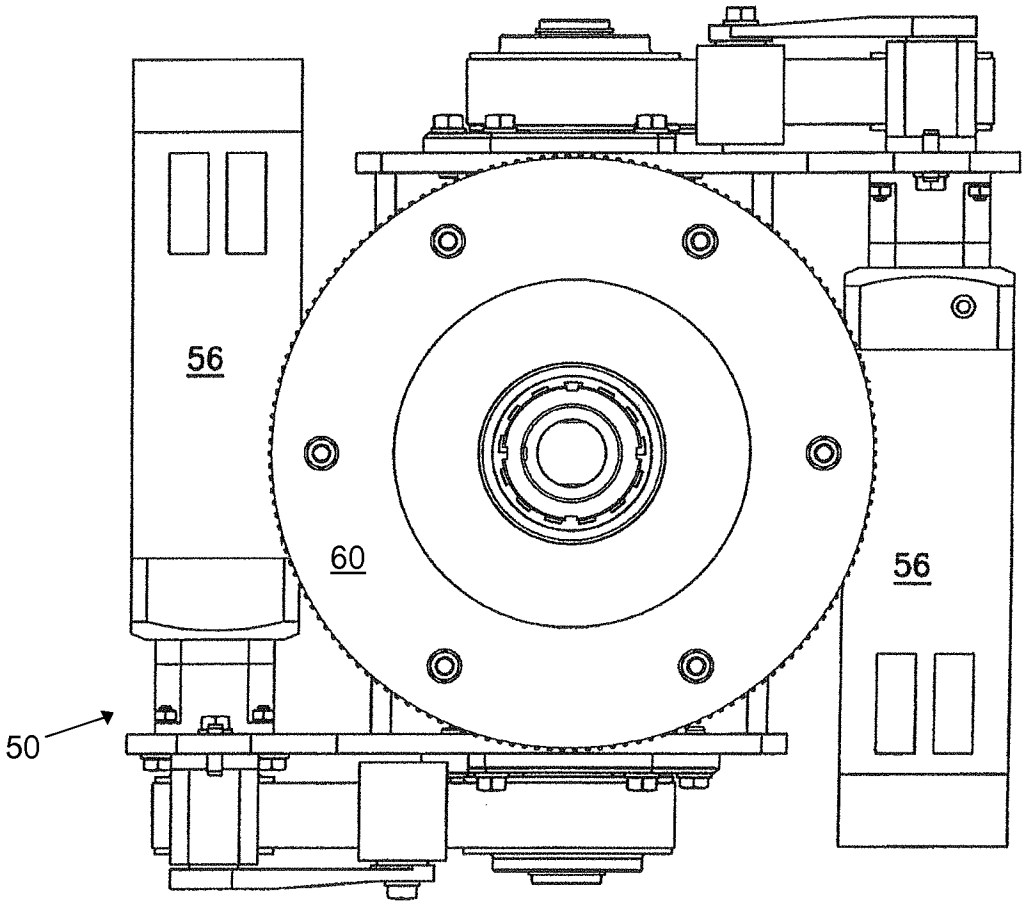
FIG. 12 is a top plan view of the drive device.
Figure 13:
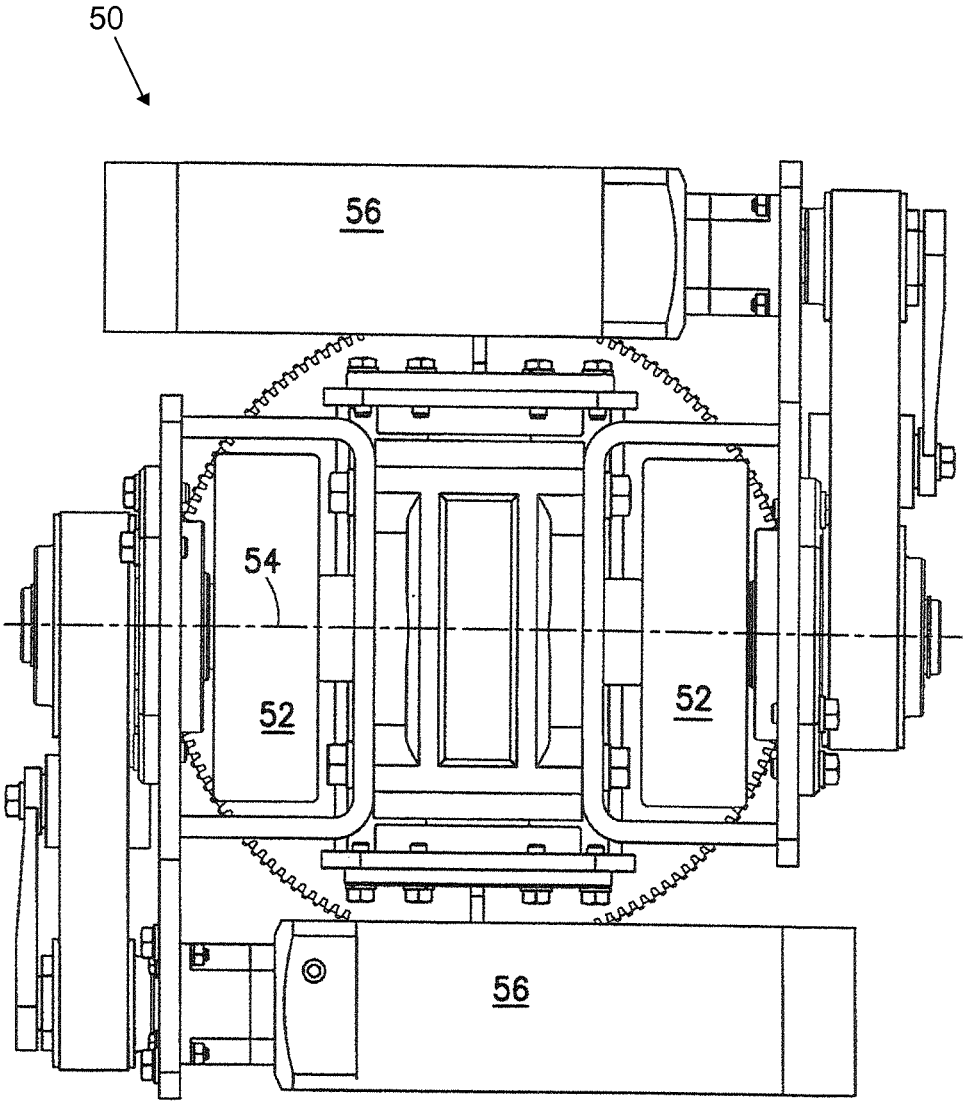
FIG. 13 is a bottom plan view of the drive device.
Figure 14:
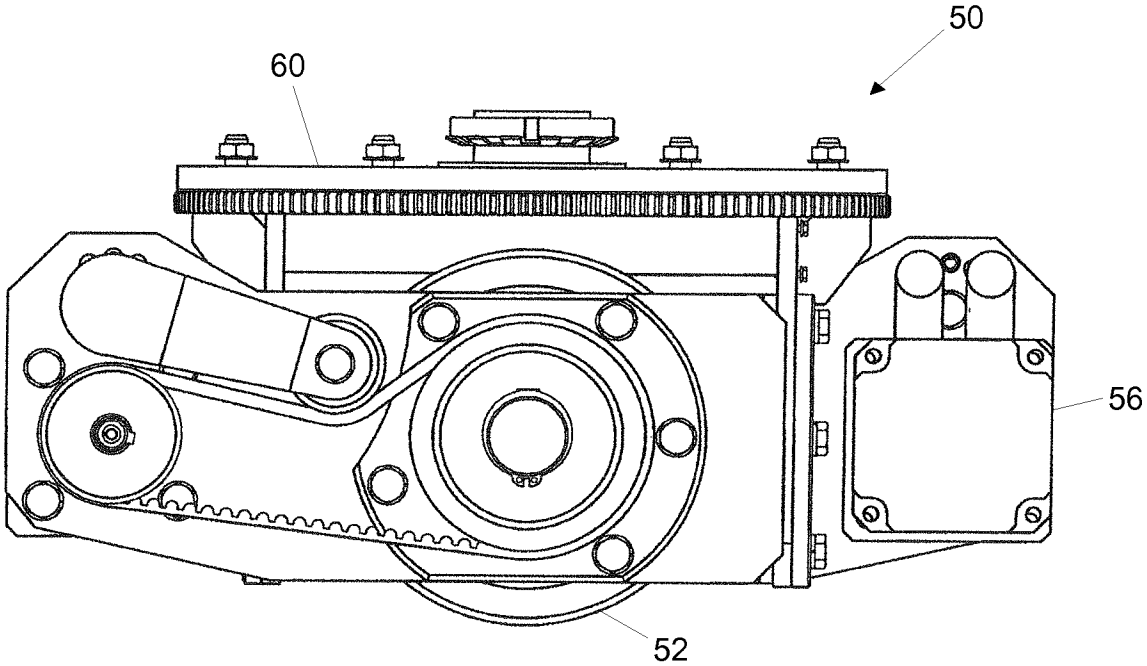
FIG. 14 is a side elevational view of the drive device.

The parking system of the invention utilizes a plurality of trays 24. Each tray 24 includes a substantially rectangular parking platform 26 with a top surface 28 for supporting a vehicle thereon and a bottom surface 29. Legs 30 project down from the parking platform 26 for supporting the parking platform 26 in a spaced position from the floor. The legs 30 flare outward or inward slightly so that a plurality of parking trays 24 can be nested in a vertical array for storage and transportation. The ingress and egress bays 12 and 14 each include a recessed floor 20 dimensioned to receive one of the trays 24. The recessed floor 20 is lower than the floor 21 at other locations in the ingress or egress bays 12 or 14 by a distance substantially corresponding to the height of the tray. Thus, the top surface 28 of the parking platform 26 will be substantially flush with the floor 21 adjacent the recessed floor 20 when the tray 24 is positioned in the ingress or egress page 12 for 14 as shown in FIGS. 3 and 4 additionally, the floor in the queuing area 18 is substantially flush with the floor in the recess 20 as shown most clearly in FIG. 3

The parking system of the invention also includes automated guided vehicles (AGV) 32 for transporting the trays 24 throughout the parking garage 10 with or without vehicles thereon. Each AGV 32 includes a substantially rectangular frame 34 that includes an interior 36 for accommodating the operative parts of the AGV 32. More particularly, the interior 36 of the frame 34 includes an array of rechargeable batteries 38 for providing power to operate the AGV 32. The batteries 38 communicate with one or more recharging connectors 40 in a peripheral region of the frame 34. Additionally, the interior of the frame 34 includes a controller 42 for controlling the various operative parts of the AGV 32 as explained herein. The controller 42 further communicates with a central control for the parking garage 10.

The AGV 32 further includes four platform lifts 44 disposed within the interior 36 of the frame 34. More particularly, two platform lifts 44 are disposed in proximity to each of the respective longitudinal ends of the AGV 32. The two platform lifts 44 at each end of the AGV 32 are connected to a tray support platform 46 that can be raised or lowered relative to the frame 34. At the lowered or retracted position, the tray support platforms 46 are substantially flush with the upper surface of the frame 34. In the raised or extended position, the tray support platforms 46 project slightly above the upper surface of the frame 34. The platform lifts 44 and the respective tray support platforms 46 are used to raise and lower the trays 24 with or without vehicles thereon as explained herein.

The AGV 32 further includes four drive devices 50 disposed at corners of a rectangle and disposed inwardly of the elevator mechanisms 44. Each drive device 50 includes two wheels 52 mounted for rotation about a horizontal axis 54. The two wheels 52 of each drive device 50 are driven respectively by two drive motors 56 so that each wheel 52 has a dedicated drive motor 56. The assembly of wheels 52 and drive motors 56 on each drive device 50 is mounted to a turntable 60 so that the assembly of wheels 52 and drive motors 56 on each of the drive devices 50 can be rotated about a vertical axis. The turntable 60 freely rotatable about a vertical axis and is driven rotatably by the wheels 52 and their respective drive motors 56. The drive motors 56 are operated independently pursuant to signals received from the controller 42 of the respective AGV 32, which in turn is driven by controls of the parking garage.

The longitudinal and lateral dimensions of each AGV 32 enable the AGV 32 to fit between the legs 30 of a tray 24. Additionally, the height dimensions of each AGV 32 enable the AGV 32 to fit beneath the parking platform 26 of the tray 24 when the tray is supported on the legs 30.

In use, a tray 24 will be positioned on the recessed floor 20 in the ingress bay 12 of the parking garage 10 at a position so that a vehicle can drive into the ingress bay 12 and onto the parking surface 28 of the parking platform 26 of the tray 24. Electro-optical signage in the ingress bay 12 will guide the driver of the vehicle to a proper position on the tray 24. The driver then will exit the vehicle and issue appropriate instructions regarding parking duration and payment method. The instructions may be delivered verbally to an employee of the parking garage 10 or may be delivered electronically, as explained above.

The tray 24 with the vehicle thereon then will be transported to the VRC 16. This transportation between the ingress bay 12 and the VRC 16 can be carried out by any of several optional means. Preferably, an AGV 32 will move beneath the tray 24 so that the AGV 32. The platform lifts 44 of the AGV 32 then will be moved into their extended positions so that the tray 24 with the vehicle thereon is elevated slightly from the floor 20 so that the AGV 32 can transport the tray 24 and the vehicle thereon to the VRC 16. Alternatively, a conveying mechanism can move the vehicle from the ingress bay 12 to the VRC 16.

The VRC 16 will move the tray 24 with the vehicle thereon to a selected floor in the garage 10 for parking. An AGV 32 then will transport the tray 24 and the vehicle to a preselected parking location. More particularly, the AGV 32 will move between the legs 30 of the tray 24 and into a position for properly supporting the tray 24. This accurate positioning can be determined by sensors on the AGV 32 and/or on the tray 24. The proper positioning of the AGV 32 relative to the tray 24 will be transmitted to the controller 42 of the AGV 32, which will generate a signal to operate the platform lifts 44 of the AGV 32. The platform lifts 44 will cause the tray support platforms 46 to move into the extended position so that the tray 24 with the vehicle thereon is lifted sufficiently for the legs 30 of the tray 24 to be spaced from the floor. The controller 42 of the AGV 32 then will issue appropriate signals for operating the drive devices 50 of the AGV 32. More particularly, the control of the AGV 32 will cause the drive motors 56 to drive the wheels 52 so that the AGV 32 delivers the tray 24 and the vehicle thereon to an appropriate pre-designated parking location. In this regard, the drive motors 56 all can be operated independently of one another pursuant to instructions received from the controller 42. In some instances, the motors 56 on a single drive device 50 will be operated in opposite directions for turning the turntable 60 to steer the AGV 32 in the required direction.

Once at the designated parking location, the controller 42 of the AGV 32 will issue instructions to the respective platform lets 44 to retract the tray support platforms 46 sufficiently for the legs 30 of the tray 24 to rest on the floor. The controller 42 of the AGV 32 then will operate the drive motors 56 to move the AGV 32 away from the tray 24. The AGV 32 then will be directed to another location for performing more work, such as returning another tray 24 and the vehicle thereon to the appropriate VRC 16 to have the vehicle delivered to the egress bay 14.

What is claimed is:

1. An automated guided vehicle for use with a tray having a parking platform capable of supporting a vehicle thereon, the automated guided vehicle comprising:

a frame having opposite top and bottom surfaces;

a plurality of tray support platforms mounted to the frame for movement along a moving direction between an extended position where the tray support platforms are raised above the top surface of the frame and a retracted position where the tray support platforms are lower than in the extended position;

a plurality of platform lifts mounted to the frame and operative for moving the tray support platforms between the extended position and the retracted position;

a plurality of drive devices mounted to the frame, each drive device including:

a turntable rotatable about a rotational axis substantially parallel to the moving direction of the tray support platforms, a plurality of wheels mounted to the turntable and rotatable about axes substantially perpendicular to the rotational axis of the turntable, the wheels projecting below the bottom surface of the frame, a plurality of dedicated drive motors mounted on the turntable of each of the drive devices and disposed so that each of the wheels has one of the drive motors and so that the wheels and the drive motors of each drive device rotate with the turntable, each of the drive motors being independently operable and being selectively reversibly operable; and a controller for controlling rotational directions of the respective wheels and controlling operation of the platform lifts.

2. The automated guided vehicle of claim 1, wherein the plurality of drive devices comprise four drive devices.

3. The automated guiding device of claim 1, wherein the drive motors are bidirectional drive motors for selectively rotating the wheels in opposite directions.

4. The automated guiding device of claim 1, wherein the plurality of tray support platforms comprises two tray support platforms disposed at opposite respective ends of the frame.

5. The automated guiding device of claim 4, wherein the drive devices are disposed between the two tray support platforms.

6. A vehicle moving assembly for moving parked vehicles in a parking facility, the assembly comprising:

at least one tray having a parking platform for supporting a vehicle thereon and a plurality of legs projecting from the parking platform for keeping the parking platform in an elevated position on a supporting surface of the parking facility;

at least one automated guiding device having a frame dimensioned for fitting between the legs of the tray, a plurality of drive devices mounted to the frame, each drive device including:

a turntable rotatable about a rotational axis substantially perpendicular to the supporting surface, a plurality of wheels mounted to the turntable and rotatable about axes substantially parallel to the supporting surface, the wheels projecting below the bottom surface of the frame, the frame and the wheels being dimensioned so that the automated guiding device can move beneath the parking platform of the tray, a plurality of dedicated drive motors mounted on the turntable of each of the drive devices and disposed so that each of the wheels has one of the drive motors and so that the drive motors rotate the respective wheels, each of the drive motors being independently operable and being selectively reversibly operable for selectively moving the automated guided vehicle and rotating the respective turntable, and a plurality of tray support platforms mounted to the frame for movement between a retracted position and an extended position where the tray support platforms are raised above the top surface of the frame and a plurality of platform lifts mounted to the frame and operative for moving the tray support platforms between the extended position and the retracted position for selectively lowering and raising the tray with the vehicle supported thereon.

7. The vehicle moving assembly of claim 6, further comprising a controller for controlling operation of the drive motors and the platform lifts.

8. The vehicle moving assembly of claim 7, further comprising a plurality of rechargeable batteries mounted to the frame.

9. The vehicle moving assembly of claim 6 wherein the legs of the tray are aligned for nesting the tray with another substantially identical tray.

10. A parking system comprising:

a parking facility having at least one access location and a plurality of vehicle parking locations;

a plurality of trays, each of the trays having a parking platform for supporting a vehicle thereon and a plurality of legs projecting from the parking platform for keeping the parking platform in an elevated position on a supporting surface of the parking facility;

a plurality of automated guided vehicles, each of the automated guided vehicles having a frame dimensioned for fitting between the legs of the tray, a plurality of drive devices mounted to the frame, each drive device including:

a turntable rotatable about a rotational axis substantially perpendicular to the supporting surface, a plurality of wheels mounted to the turntable and rotatable about axes substantially parallel to the supporting surface, the wheels projecting below the bottom surface of the frame, the frame and the wheels being dimensioned so that the automated guiding device can move beneath the parking platform of the tray, a plurality of dedicated drive motors mounted on the turntable of each of the drive devices and disposed so that each of the wheels has one of the drive motors and so that the drive motors rotate the respective wheels, each of the drive motors being independently operable and being selectively reversibly operable for selectively moving the automated guided vehicle and rotating the respective turntable, and a plurality of tray support platforms mounted to the frame for movement between a retracted position and an extended position where the tray support platforms are raised above the top surface of the frame and a plurality of platform lifts mounted to the frame and operative for moving the tray support platforms between the extended position and the retracted position for selectively lowering and raising the tray with the vehicle supported thereon.

11. The parking system of claim 10, further comprising a central controller in the parking facility for associating a vehicle with one of the parking locations in the facility and an automated guided vehicle controller mounted on the automated guided vehicle and communicating with the central controller for controlling operation of the drive motors and the platform lifts for selectively moving a vehicle on the parking platform of one of the tray is between the access location and the parking location associated with the respective vehicle.

12. The parking system of claim 11 wherein the automated guided vehicle controller controls the drive motors for selectively rotating the wheels and thereby selectively rotating the turntables for moving the vehicles between the access location and the parking location associated with the respective vehicle.

13. The parking system of claim 10, wherein the tray has two front legs and two rear legs, the automated guided vehicle being dimensioned to move between the two front legs, between the two rear legs or between a front leg and a rear leg.

14. The parking system of claim 10, wherein the turntable is freely rotatable and is rotatably driven by the action of the drive motors on the wheels.

15. The parking system of claim 10, wherein the plurality of drive devices comprise four drive devices.

* * * * *